US007140350B2

(12) United States Patent
Kondo et al.

(10) Patent No.: US 7,140,350 B2
(45) Date of Patent: Nov. 28, 2006

(54) THROTTLE BODY AND ENGINE OF MOTORCYCLE HAVING THROTTLE BODY

(75) Inventors: Yasushi Kondo, Kawasaki (JP); Hiroshi Kikuchi, Kawasaki (JP); Takashi Fukami, Akashi (JP); Tetsuya Mori, Kobe (JP)

(73) Assignees: Keihin Corporation, Tokyo (JP); Kawasaki Jukogyo Kabushiki Kaisha, Kobe (JP)

( * ) Notice: Subject to any disclaimer, the term of this patent is extended or adjusted under 35 U.S.C. 154(b) by 36 days.

(21) Appl. No.: 11/111,477

(22) Filed: Apr. 20, 2005

(65) Prior Publication Data

US 2005/0247287 A1 Nov. 10, 2005

(30) Foreign Application Priority Data

| | | |
|---|---|---|
| Apr. 22, 2004 | (JP) | 2004-126586 |
| Aug. 20, 2004 | (JP) | 2004-240501 |
| Aug. 25, 2004 | (JP) | 2004-245295 |
| Apr. 5, 2005 | (JP) | 2005-108670 |

(51) Int. Cl.
*F02D 9/10* (2006.01)

(52) U.S. Cl. ..... 123/336; 123/442; 123/337

(58) Field of Classification Search ..... 123/336, 123/337, 442

See application file for complete search history.

(56) References Cited

U.S. PATENT DOCUMENTS 3,807,367 A * 4/1974 Lamm ..... 123/442
4,726,341 A * 2/1988 Muranaka et al. ..... 123/442
6,202,626 B1 * 3/2001 Ito et al. ..... 123/336

FOREIGN PATENT DOCUMENTS

JP 2003-083171 3/2003

* cited by examiner

*Primary Examiner*—Erick R Solis
(74) *Attorney, Agent, or Firm*—Alleman Hall McCoy; Russell & Tuttle LLP

(57) ABSTRACT

A throttle body configured to supply air to an air-intake port of an engine is disclosed. The throttle body typically includes an air-intake passage through which air flows. The air-intake passage at least partially has a non-perfect circle portion with a cross-section of a non-perfect circle shape in a direction substantially perpendicular to a direction of an air flow of air taken in from outside. The non-perfect circle shape typically has long and short axes. At least one of a first throttle valve and a second throttle valve typically is mounted within the non-perfect circle portion of the air-intake passage. The first throttle valve and second throttle valve may include throttle valve members each having a shape conforming to the non-perfect circle shape of the cross-section of the non-perfect circle portion of the air-intake passage. Typically, the first throttle valve and the second throttle valve are each configured to control an amount of the air flow. At least one of the first throttle valve and the second throttle valve is configured to open and close to substantially open and close the air-intake passage.

11 Claims, 15 Drawing Sheets

THROTTLE BODY AND ENGINE OF MOTORCYCLE HAVING THROTTLE BODY

BACKGROUND OF THE INVENTION

1. Field of the Invention

The present invention relates to a throttle body configured to control an amount of air flowing toward an air-intake port of an engine. More particularly, the present invention relates to a tandem valve type throttle body including a main throttle valve that is mounted within an air-intake passage formed in the throttle body and that is configured to be controlled to open and close by an accelerator lever, and a sub-throttle valve that is mounted within a region of the air-intake passage which is located upstream of the main throttle valve in an air flow and that is configured to be operated to open and close by an actuator such as an electromagnetic actuator, and an engine of a motorcycle having the throttle body.

2. Description of the Related Art

A conventional tandem valve type throttle body is disclosed in Japanese Patent Application Publication No. 2003-83171, owned by one assignee of the subject application Keihin Corporation. Turning to FIGS. 3 and 4, a conventional tandem valve type throttle body is shown generally. A throttle body T is constructed to contain an air-intake passage 10 extending therein laterally relative to an engine. A main throttle valve member 12 is located within a downstream air-intake passage 10*b* of the throttle body T. As used herein, "upstream" and "downstream" are meant to define a direction of a flow of air taken in from outside. The main throttle valve member 12 is attached to a main throttle valve shaft 11 rotatably mounted to the throttle body T. The main throttle valve shaft 11 is rotatably operated through a mechanical or electric system by an operator (rider). The main throttle valve member 12 is configured to substantially open and close the air-intake passage 10 according to the rotation of the main throttle valve shaft 11.

A sub-throttle valve member 13 is mounted within an upstream air-intake passage 10*a* located upstream of the main throttle valve member 12. The sub-throttle valve member 13 is attached to a sub-throttle valve shaft 14 rotatably mounted to the throttle body T. The sub-throttle valve shaft 14 is configured to be operated to open and close by an electromagnetic actuator such as a motor. The sub-throttle valve member 13 is forcibly closed, for example, during traction control. The downstream air-intake passage 10*b* within which the main throttle valve member 12 is mounted has a cross-section of a perfect circle shape with a diameter "d". The upstream air-intake passage 10*a* within which the sub-throttle valve member 13 is mounted has a cross-section of a perfect circle shape with a diameter "D". The diameter "D" is larger than the diameter "d" (D>d). Such a construction is capable of reducing air-intake resistance of air flowing through the downstream air-intake passage 10*b*.

When applied to a multi-cylinder engine, a plurality of throttle bodies T are arranged to extend laterally relative to an engine block of the engine. In the case of a three-cylinder engine, as shown in FIG. 4, three throttle bodies T are arranged to extend laterally relative to the engine block in the following order from the left to the right: a first throttle body T1, a second throttle body T2, and a third throttle body T3.

When the plurality of throttle bodies T are arranged to extend laterally relative to the engine block of the multi-cylinder engine, the sub-throttle shafts 14 are formed by a common shaft, which extends transversely through diameters of the air-intake passages 10*a* of the throttle bodies T1, T2, and T3. The common shaft is rotatably supported by bearing holes (left and right bearing holes) 15*a* and 15*b* on left and right sides of the corresponding air-intake passage 10*a*.

As shown in FIG. 4, a right end of the common shaft protrudes rightward from the third throttle body T3 and is connected to a motor M which is configured to be controlled and driven by an ECU (engine control unit) via a gear mechanism (gear train). Air-intake pipes are respectively connected to the downstream air-intake passages 10*b* of the throttle bodies T1, T2, and T3 and are connected to cylinders of the engine, although the air-intake pipes and the engine are not shown in FIG. 4. The upstream air-intake passages 10*a* of the throttle bodies T1, T2, and T3 are respectively connected to an air cleaner box 16 (see FIG. 3). A filter element (air filter) such as a sponge (not shown) is accommodated within the air cleaner box 16. The filter element is capable of filtering air taken in from outside to remove unwanted substances therefrom, and the resulting clean air is supplied to the upstream air-intake passages 10*a* of the throttle bodies T1, T2, and T3.

In order to allow the air to flow efficiently from the downstream air-intake passage 10*b* toward the cylinders of the engine in the tandem valve type throttle body provided with the conventional sub-throttle valve member 13, a cross-sectional area of the upstream air-intake passage 10*a* located upstream of the sub-throttle valve member 13 may be increased. In this case, the cross-sectional area of the upstream air-intake passage 10*a* having a cross-section with a perfectly circular shape may be increased by increasing a diameter of the upstream air-intake passage 10*a* from "D" to "D1" (D1>D). As shown in FIG. 4, the upstream air-intake passage 10*a* with the increased diameter "D1" is represented by a dotted line.

In accordance with the construction of the air-intake passage 10*a* with the increased diameter "D1", the amount of the air flowing from the upstream air-intake passage 10*a* toward the downstream air-intake passage 10*b* increases, and hence efficiency of the air flow from the downstream air-intake passage 10*b* toward the cylinders of the engine increases. However, the following problems may arise.

First, a dimension G of an outer shape of the entire throttle bodies T1, T2, and T3 in a width direction of a motorcycle increases from G1 to G2 (G2>G1). If the dimension G of the outer shape of the throttle bodies T1, T2, and T3 increases, then the conventional air cleaner box 16 cannot be employed. So, there is a need for an air cleaner box having a larger size or another configuration. Such an air cleaner box is difficult to mount in a limited storage space of the motorcycle. In addition, if the sizes of the air cleaner box and the throttle bodies increase in the width direction of the motorcycle, then the motorcycle becomes larger, which may force the rider to open legs when straddling the motorcycle. That is, the rider cannot ride the motorcycle in a natural posture.

Second, since the bearing holes of the throttle body must be varied, a length of bearing portions of the sub-throttle valve shaft decreases. For example, the length of the bearing portion corresponding to the first bearing hole 15*a* decreases from "L1" to "L2" (L1>L2), and the length of the bearing portion corresponding to the second bearing hole 15*b* decreases from "L3" to "L4".

If the length of the bearing portion of the sub-throttle valve shaft thus decreases, it becomes necessary to reconduct a durability test for the bearing portion. This significantly increases the number of steps for a check test of a material and treatment (heat treatment or surface treatment, etc) of the sub-throttle valve shaft 14.

As a solution to the first problem, pitches P1 and P2 of adjacent throttle bodies T1, T2, and T3 may be reduced to reduce the dimension G. As a solution to the second problem, the pitches P1 and P2 may be increased to increase the length "L" of the bearing holes 15*a* and 15*b*. However, the pitches P1 and P2 are determined according to the arrangement of the air-intake passages (intake ports) of the engine, and hence are incapable of being easily changed. The change in the arrangement of the air-intake passages unavoidably results in significant design change in the engine, and is extremely difficult.

Japanese Patent Application No. 2004-87118, owned by another assignee of the subject application, KAWASAKI JUKOGYO KABUSHIKI KAISHA, discloses an air-intake pipe having a passage with a cross-section having long and short axes and a throttle valve pivotally mounted within the passage of the air-intake pipe.

SUMMARY OF THE INVENTION

The present invention addresses the above described conditions, and an object of the present invention is to provide a tandem valve type throttle body which is capable of increasing an air flow from an upstream air-intake passage within which a sub-throttle valve is mounted to a downstream air-intake passage within which a main throttle valve is mounted, i.e., increasing an amount of air-intake, without increasing a size of an air box or throttle bodies in a width direction, for example, by changing pitches of arrangement of adjacent throttle bodies, and to provide an engine of a motorcycle provided with the throttle body.

According to one aspect of the present invention, there is provided a throttle body configured to supply air to an air-intake port of an engine, comprising an air-intake passage through which air flows, the air-intake passage at least partially having a non-perfect circle portion with a cross-section of a non-perfect circle shape in a direction substantially perpendicular to a direction of an air flow of air taken in from outside, the non-perfect circle shape having long and short axes, the short axis extending in a width direction of the throttle body; and at least one of a first throttle valve and a second throttle valve which are mounted within the non-perfect circle portion of the air-intake passage and include throttle valve members each having a shape conforming to the non-perfect circle shape of the cross-section of the non-perfect circle portion of the air-intake passage, the first throttle valve and the second throttle valve being each configured to control an amount of the air flow; wherein the at least one of the first throttle valve and the second throttle valve is configured to be opened and closed to substantially open and close the air-intake passage. As used herein, the first throttle valve may be a main throttle valve and the second throttle valve may be a sub-throttle valve or vise versa.

In accordance with the throttle body structured as described above, since the air-intake passage located on an upstream side at least partially has a non-perfect circle portion with a cross-section of a non-perfect circle shape having long and short axes in a direction substantially perpendicular to a direction of the air flow, a cross-sectional area of the air-intake passage can be increased without increasing the dimension of the throttle body in a width direction of the motorcycle. As a result, air-intake efficiency of the air flow from the upstream air-intake passage to the downstream air-intake passage can be increased without increasing the dimension of the throttle body in the width direction. In addition, since the length of the bearing portion of the sub-throttle valve shaft that corresponds to the bearing hole of the air-intake passage is substantially equal to that of a conventional throttle body, a durability test for the bearing portion of the sub-throttle valve shaft becomes unnecessary. Furthermore, the conventional air cleaner box is applicable to the throttle body without increasing a dimension in the width direction, and hence the throttle body is easily mounted.

The cross-section of the non-perfect circle portion may be of a substantially oval shape or a substantially elongated-circle shape. Especially in the case of the elongated-circle shape, a clearance between the first or second throttle valve and the air-intake passage is desirably minimized.

According to another aspect of the present invention, there is provided a throttle body configured to supply air to an air-intake port of an engine, comprising: an air-intake passage through which the air flows, the air-intake passage being configured to extend within the throttle body; a main throttle valve member pivotally mounted within the air-intake passage and attached to a main throttle valve shaft; a sub-throttle valve member that is pivotally mounted within a region of the air-intake passage which is located upstream of the main throttle valve member and that is attached to a sub-throttle valve shaft, the sub-throttle valve member being configured to be driven by a motor; wherein the region of the air-intake passage that is located upstream of the main throttle valve member has a substantially oval shape having long and short axes or a substantially elongated circle shape having long and short axes, the short axis extending to conform to an axis of the sub-throttle valve shaft and the long axis extending in a direction substantially perpendicular to the axis of the sub-throttle valve shaft.

In accordance with the throttle body thus constructed, since the cross-section of the upstream region of the upstream air-intake passage is of the substantially oval shape or the substantially elongated circle shape, which has the short axis extending to conform to the axis of the sub-throttle valve shaft and the long axis extending in the direction substantially perpendicular to the axis of the sub-throttle valve shaft, pitches of the throttle bodies are not changed and the dimension of the outer shape of the throttle bodies in the direction of the axis of the sub-throttle valve shaft is substantially equal to that of the conventional throttle bodies. By increasing the cross-sectional area of the air-intake passage of the throttle bodies without changing the pitches and the outer shape of the throttle bodies, efficiency of the air flow from the upstream air-intake passage toward the downstream air-intake passage increases. In addition, since the length of the bearing portion of the sub-throttle valve shaft that corresponds to the bearing hole of the air-intake passage is substantially equal to that of the conventional throttle body, a durability test for the bearing portion of the sub-throttle valve shaft becomes unnecessary. Furthermore, the conventional air cleaner box is applicable to the throttle body without increasing a dimension in the width direction, and hence is easily mounted.

According to another aspect of the present invention, there is provided an engine of a motorcycle comprising a cylinder having a cylinder head; an intake passage formed within the cylinder head; a throttle body disposed upstream of the intake passage in an air flow of air taken in from outside, the throttle body including: an air-intake passage through which air flows, the air-intake passage at least partially having a non-perfect circle portion with a cross-section of a non-perfect circle shape in a direction substantially perpendicular to a direction of the air flow, the non-perfect circle shape having long and short axes, the short axis extending in a width direction of the throttle body; and a first throttle valve or a second throttle valve, or the first and second throttle valves which are mounted within the non-perfect circle portion of the air-intake passage and include throttle valve members each having a shape conforming to the non-perfect circle shape of the cross-section of the non-perfect circle portion of the air-intake passage, the first throttle valve and the second throttle valve being each configured to control an amount of the air flow; wherein the at least one of the first throttle valve and the second throttle valve is configured to be opened and closed to substantially open and close the air-intake passage. In accordance with the engine thus constructed, air-intake efficiency of the engine increases without increasing the dimension of the throttle body in the width direction.

The cross-section of the non-perfect circle portion may have a substantially oval shape or a substantially elongated circle shape.

The engine may further comprise an introducing duct connected to an upstream end of the air-intake passage of the throttle body and configured to extend to cross the air flow such that a downstream portion of a wall of the introducing duct in an air flow of the air before being introduced into the duct is longer than an upstream portion of the wall of the introducing duct. Since the air can be drawn into the throttle body efficiently by utilizing the downstream portion of the wall of the introducing duct, the air-intake efficiency of the engine increases.

The engine may further comprise a fuel injector having a fuel injection port configured to open toward an opening of the introducing duct. The downstream portion of the wall of the introducing duct may be configured to extend so as to be slightly shorter or longer than a length from a base end of the downstream portion to a location in a longitudinal direction of the introducing duct at which the fuel injection port and a tip end of the downstream portion conform to each other. In such a structure, the injected fuel is efficiently drawn into the introducing duct.

The introducing duct may be configured to open such that a line connecting a tip end of the upstream portion of the wall of the duct to a tip end of the downstream portion of the wall of the duct is concave-shaped as seen from a side. Since air from a lateral side is also drawn into the introducing duct, the air-intake efficiency further increases.

The cross-section of the non-perfect circle portion may have a substantially oval shape or a substantially elongated circle shape, and the engine may further comprise an introducing duct connected to an upstream end of the air-intake passage of the throttle body. The introducing duct may have a cross-section of a substantially oval shape or a substantially elongated circle shape to conform to the non-perfect circle shape of the cross-section of the air-intake passage of the throttle body when sectioned in a direction which is perpendicular to the air flow of the taken-in air. Such an introducing duct has a sufficient air-intake cross-sectional area and is compactly configured in the direction of the short axis of the oval shape or the elongated-circle shape.

The cylinder may include a plurality of cylinders, and the throttle body may include a plurality of throttle bodies respectively attached to the cylinders and having air-intake passages. The engine may further comprise a plurality of introducing ducts connected to upstream ends of the air-intake passages of the throttle bodies, at least one of the introducing ducts being configured not to have a length equal to lengths of remaining introducing ducts. Since the air is drawn into the respective introducing ducts without any interference, the air-intake efficiency further increases.

One of the first and second throttle valves which is located on upstream side in the air flow may be configured to be opened and closed by an actuator.

The above and further objects and features of the invention will more fully be apparent from the following detailed description with accompanying drawings.

DETAILED DESCRIPTION OF THE PREFERRED EMBODIMENTS

Hereinafter, embodiments of a tandem valve type throttle body of the present invention will be described with reference to the accompanying drawings.

(Embodiment 1)

Figure 1:
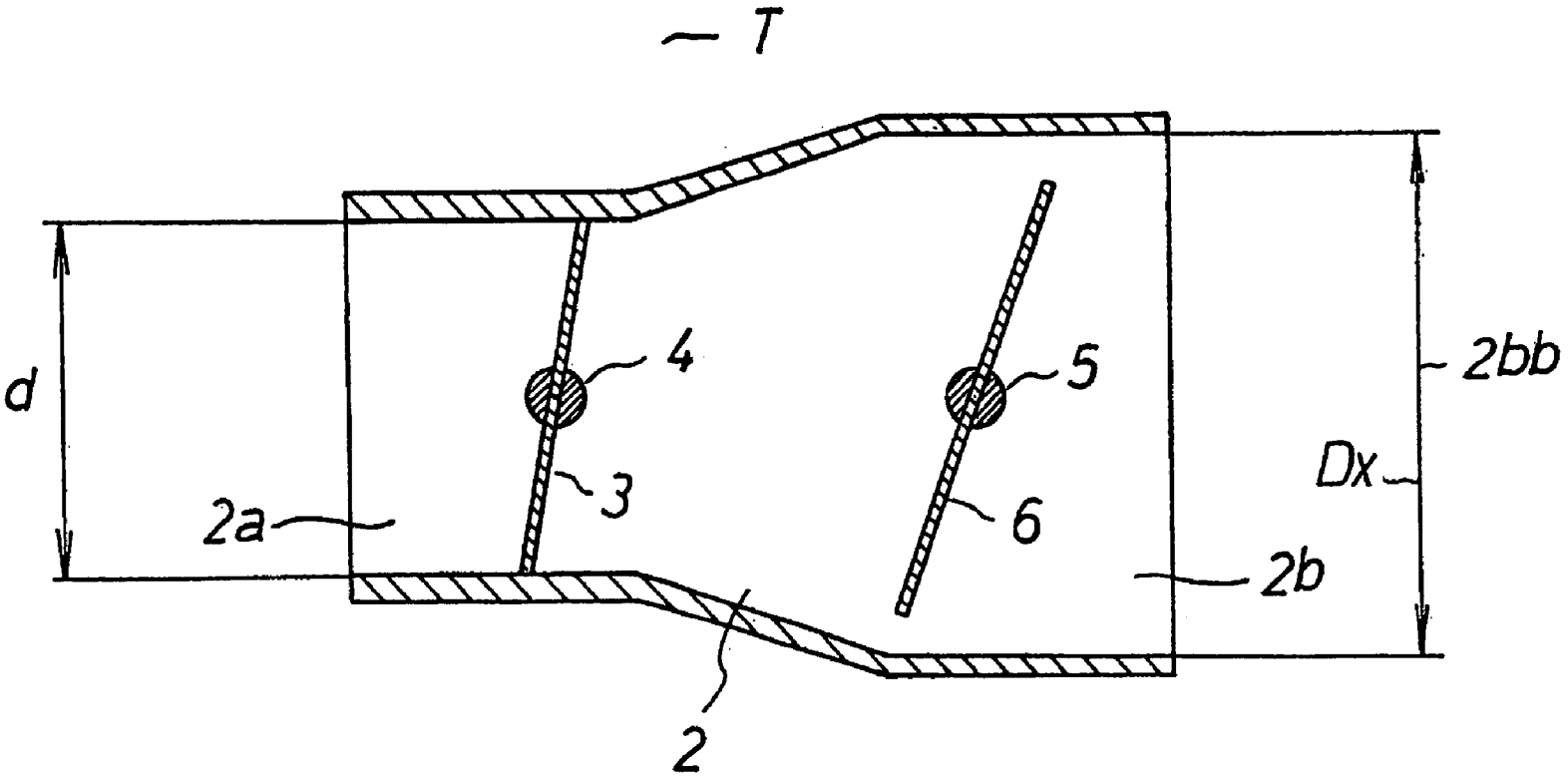
FIG. 1 is a longitudinal sectional view of a tandem valve type throttle body according to a first embodiment of the present invention.
Figure 3:
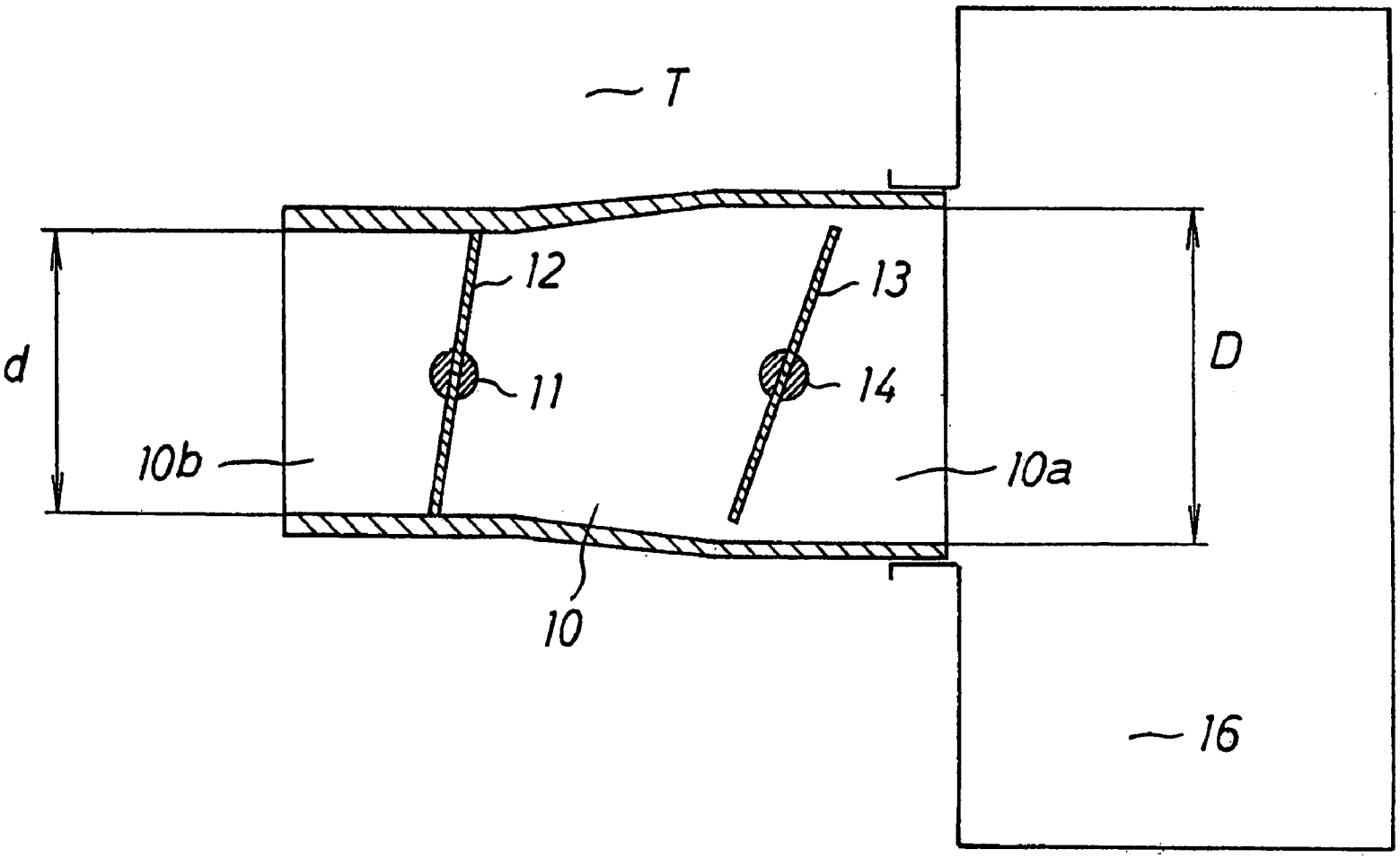
FIG. 3 is longitudinal sectional view of the conventional tandem valve type throttle body.

Turning now to FIG. 1, a throttle body T is constructed to contain an air-intake passage 2 extending laterally relative to an engine E. A main throttle valve member 3 of a main throttle valve (second throttle valve) is attached to a main throttle valve shaft 4 of the main throttle valve and is pivotally mounted within a downstream air-intake passage 2*a* of the air-intake passage 2 in an air flow. It will be appreciated that a diameter "d" of the downstream air-intake passage 2*a* is equal to the diameter "d" of the downstream air-intake passage 10*b* of FIG. 3. The downstream air-intake passage 2*a* has a cross-section of a perfect circle shape or a substantially perfect circle shape.

Figure 2:
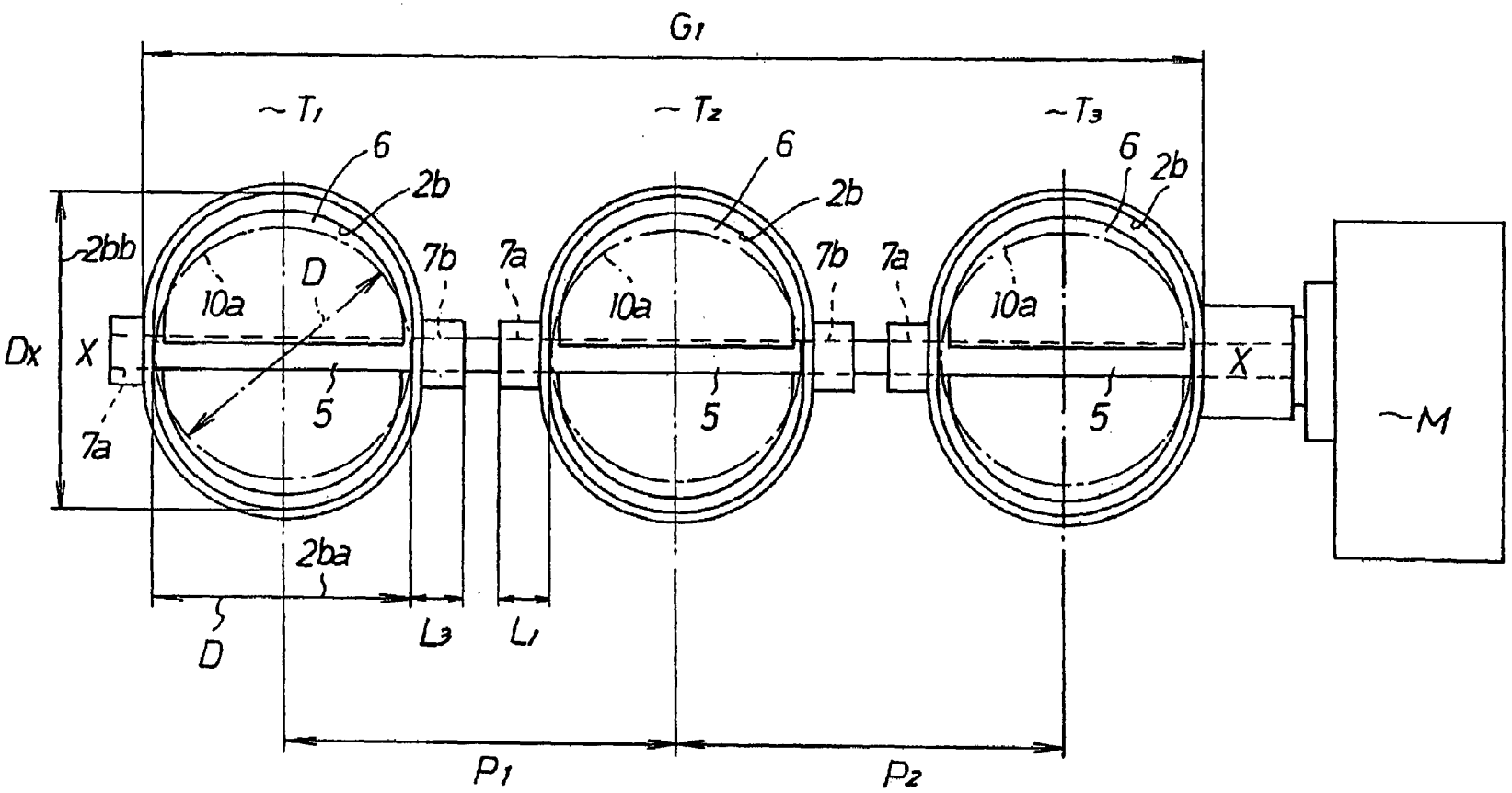
FIG. 2 is a front view of air-intake passages of a plurality of arranged tandem valve type throttle bodies, one of which is shown in FIG. 1.

A sub-throttle valve shaft 5 is disposed to extend transversely through an upstream passage (a non-perfect circle portion) 2*b* located upstream of the main throttle valve member 3. The sub-throttle valve shaft 5 is rotatably mounted to the throttle body T. A sub-throttle valve member 6 of a sub-throttle valve (first throttle valve) is attached to the sub-throttle valve shaft 5 of the sub-throttle valve and is configured to control an area of a flow passage of the upstream air-intake passage 2*b*. As shown in FIG. 2, the upstream air-intake passage 2*b* has a cross-section of a substantially oval shape or a substantially elongated circle shape including a major-axis portion (long axis) 2*bb* and a minor-axis portion (short axis) 2*ba*. The minor-axis portion 2*ba* of the substantially oval shape or the substantially elongated circle shape is configured to extend to conform to an axis X—X of the sub-throttle valve shaft 5 and the major-axis portion 2*bb* of the substantially oval shape or the substantially elongated circle shape is configured to extend in a direction perpendicular to the axis X—X.

In this embodiment, a plurality of throttle bodies T each having the air-intake passage 2 thus structured are arranged laterally relative to the engine (not show in FIG. 2) in the following order from the left to the right: a first throttle body T1, a second throttle body T2, and a third throttle body T3. As shown in FIG. 2, the throttle bodies T1, T2, and T3 are arranged with pitches P1 and P2 equal to those of the conventional throttle bodies T1, T2, and T3 of FIG. 4.

As shown in FIG. 2, the sub-throttle valve shafts 5 are formed by a common shaft which extends to conform to the short axis 2*ba* of the upstream air-intake passage 2*b* of the throttle bodies T1, T2, and T3, and are rotatably mounted to the throttle bodies T1, T2, and T3 by bearing holes 7*a* and 7*b*.

The upstream air-intake passage 2*b* having the cross-section of a substantially oval shape or a substantially elongated circle shape is structured as follows. The minor-axis portion 2*ba* of the elongated circle shape is set equal to the diameter "D" of the conventional upstream air-intake passage 10*a* of the perfect circle shape. The major-axis portion 2*bb* of the elongated circle shape is set equal to a diameter "Dx" (Dx>D1) to result in a cross-sectional area equal to the area of the upstream air-intake passage 10*a* of the perfect circle shape with the increased diameter "D1". Therefore, the area of the elongated circle shape of the upstream air-intake passage 2*b* is determined by the dimensions D and Dx of the minor-axis portion 2*ba* and the major-axis portion 2*bb* of FIG. 2 and is substantially equal to the area of upstream air-intake passage 10*a* of the perfect circle shape with the increased diameter "D1".

Figure 4:
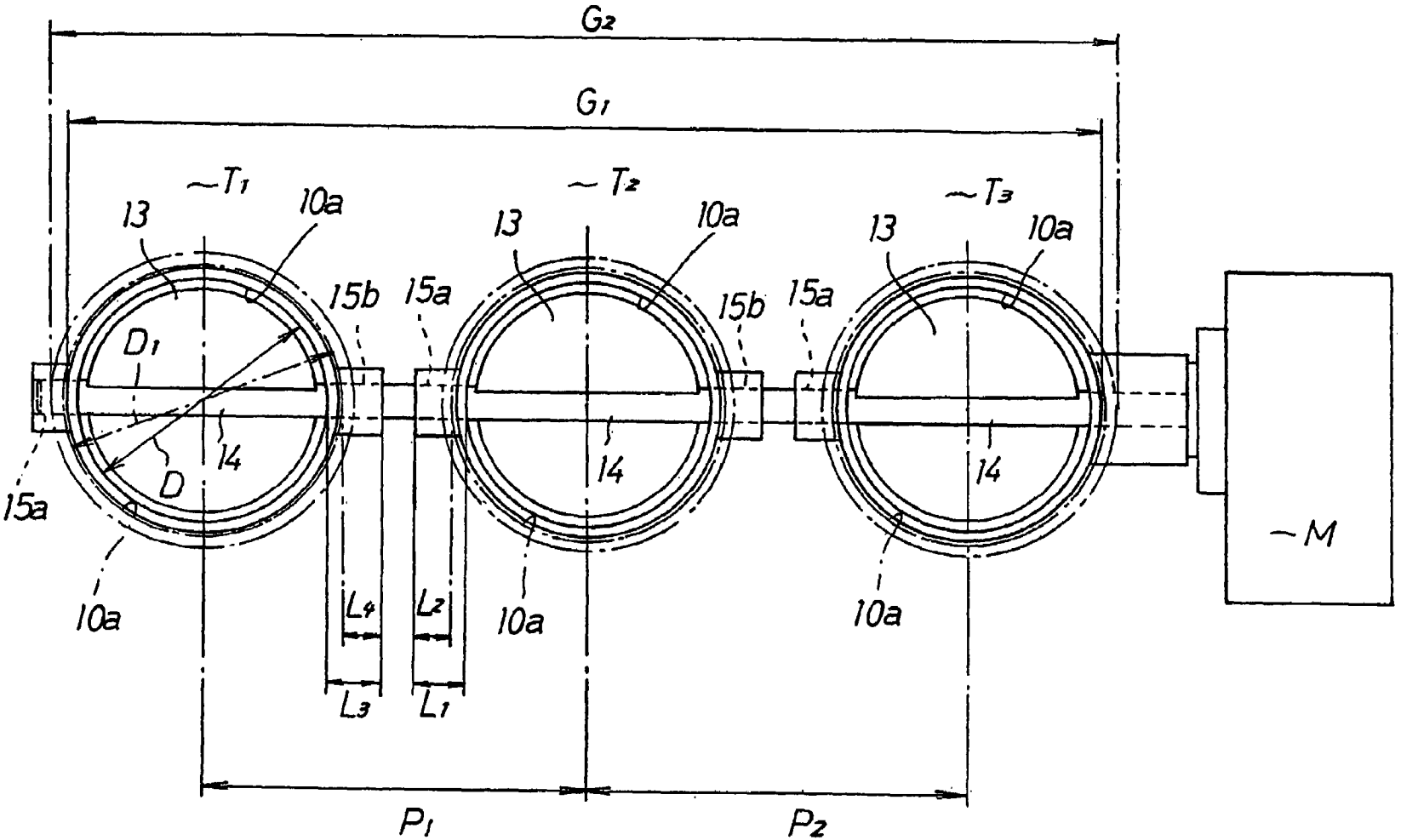
FIG. 4 is a front view of air-intake passages of a plurality of arranged throttle bodies, one of which is shown in FIG. 3.

In this structure, the pitches P1 and P2 of adjacent throttle bodies T1, T2, and T3 are equal to those of the conventional structure of FIG. 4, and the upstream air-intake passage 2*b* of the air-intake passage 2 is formed to have the cross-section of the substantially elongated circle shape and the minor-axis portion 2*ba* thereof has the dimension equal to the diameter "D" of the upstream air-intake passage 10*a* of FIG. 4. This follows that, as shown in FIG. 2, the dimension of the outer shape of the throttle bodies T1, T2, and T3 in a width direction of the motorcycle on which they are provided coincides with the conventional dimension G1 shown in FIG. 4. In addition, a length "L1" of the bearing hole 7*a* and a length "L3" of the bearing hole 7*b* are equal to the length "L1" of the bearing hole 15*a* and the length "L3" of the bearing hole 15*b* of the conventional construction of FIG. 4, respectively.

In accordance with the tandem valve type throttle body T constructed as described above, the cross-sectional area of the upstream air-intake passage 2*b* is increased relative to the cross-sectional area of the downstream air-intake passage 2*a* by forming the air-intake passage 2*b* having a cross-section of a substantially oval shape or a substantially elongated circle shape having the minor-axis portion 2*ba* and the major-axis portion 2*bb*.

By disposing the air-intake passage 2*b* of the substantially oval shape or the substantially elongated circle shape such that the axis of the minor-axis portion 2*ba* conforms to the axis X—X of the sub-throttle valve shaft 5, the dimension G1 of the outer shape of the throttle bodies T1, T2, and T3 in the width direction becomes equal to the dimension G1 of the conventional construction of FIG. 4. So, the conventional air cleaner box 16 can be easily mounted in the motorcycle.

Since the length "L1" and the length "L3" of the bearing portions of the sub-throttle valve shafts 5, corresponding to the bearing holes 7*a* and 7*b* of the throttle bodies T1, T2, and T3, are equal to those of the conventional construction of FIG. 4, it is not necessary to conduct a durability test for the bearing portions of the sub-throttle valve shafts 5. In brief, the conventional sub-throttle valve shaft 14 is applicable to the construction of FIG. 1 without alteration.

The number of the throttle bodies T may be one, more than or less than three, instead of three in this embodiment. In that case, also, the effects of the invention are obtained (Embodiment 2)

Hereinafter, a second embodiment of a throttle body equipped in the engine of the motorcycle will be described with reference to the drawings.

Figure 5:
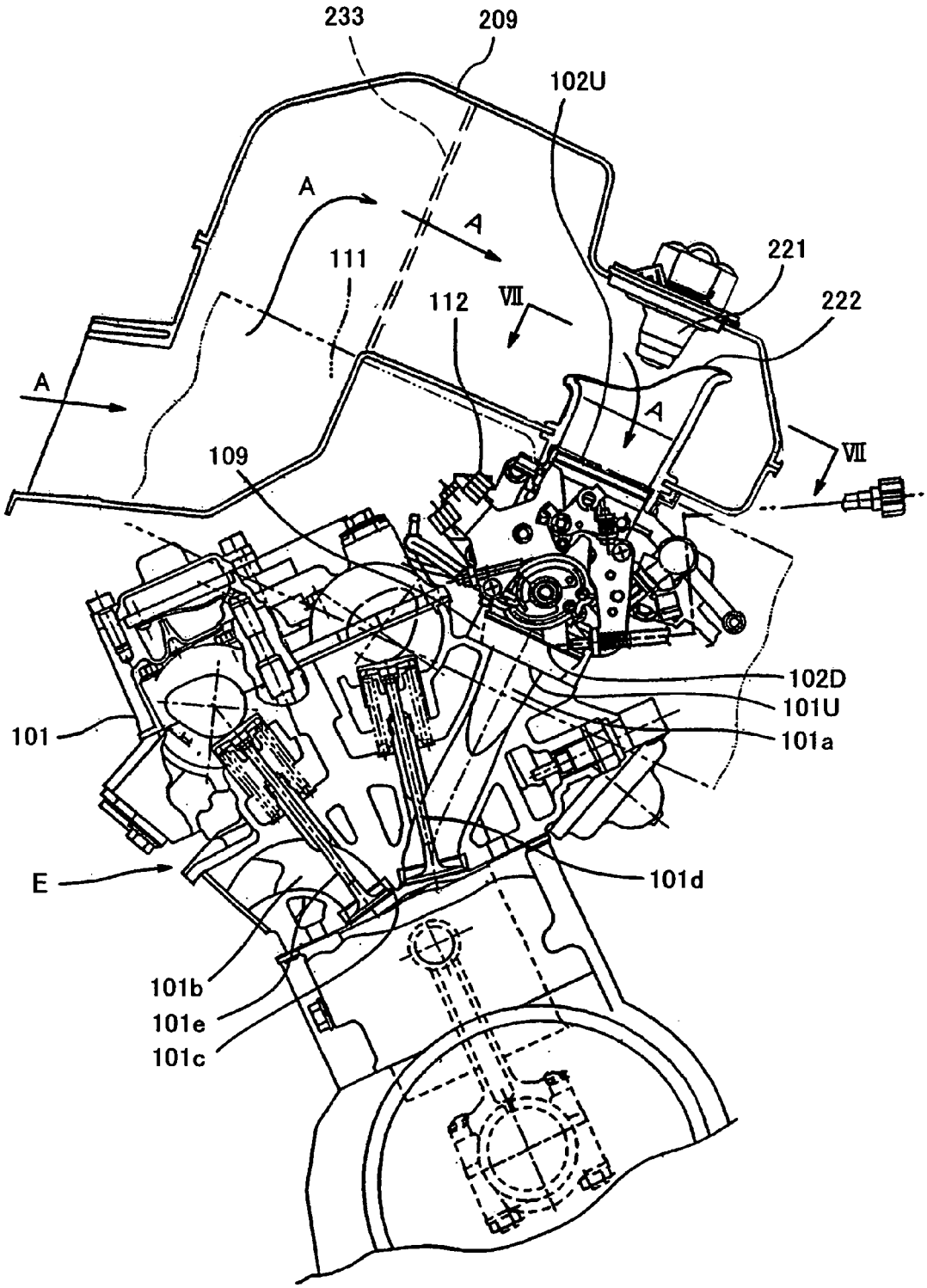
FIG. 5 is a side view, partly in cross-section, showing an air-intake passage of a cylinder head portion of an engine of a motorcycle and a throttle body connected to the air-intake passage according to a second embodiment of the present invention.

Turning to FIG. 5, an engine E is mounted in a vehicle body of the motorcycle such that it is slightly inclined forward (inclined to the left at an upper end thereof in FIG. 5). A downstream end 102D of an air-intake passage 102*a* (see FIGS. 6 and 8) of the throttle body 102 is fluidically connected to an upstream end 101 U of an air-intake passage 101*a* formed within a cylinder head 101 of the engine E through a connecting pipe 109. An upstream end 102U of the air-intake passage 102*a* is connected to a downstream end of an introducing duct 222 protruding into an air cleaner box 209. An upstream end portion of the introducing duct 222 opens inside the air cleaner box 209 to efficiently draw air A which has been taken in from outside and has been filtered by an air filter 233 mounted inside the air cleaner box 209. The introducing duct 222, the air cleaner box 209, etc., will be described in detail later. In FIG. 5, reference designator 111 denotes a main frame of a motorcycle 110 (see FIGS. 9 and 10), reference designator 101*b* denotes an exhaust passage formed within the cylinder head 101, reference designator 101*c* denotes a combustion chamber of the engine E, 101*d* denotes an air-intake valve, reference designator 101*e* denotes an exhaust valve, and reference designator 221 denotes a fuel injector configured to inject a fuel to an air flow in the introducing duct 222.

In this embodiment, as described above, the engine E is mounted in the motorcycle 110 (see FIGS. 9 and 10) in such a manner that the upper end portion of the cylinder head 10 is inclined forward by about 30 degrees.

Figure 6:
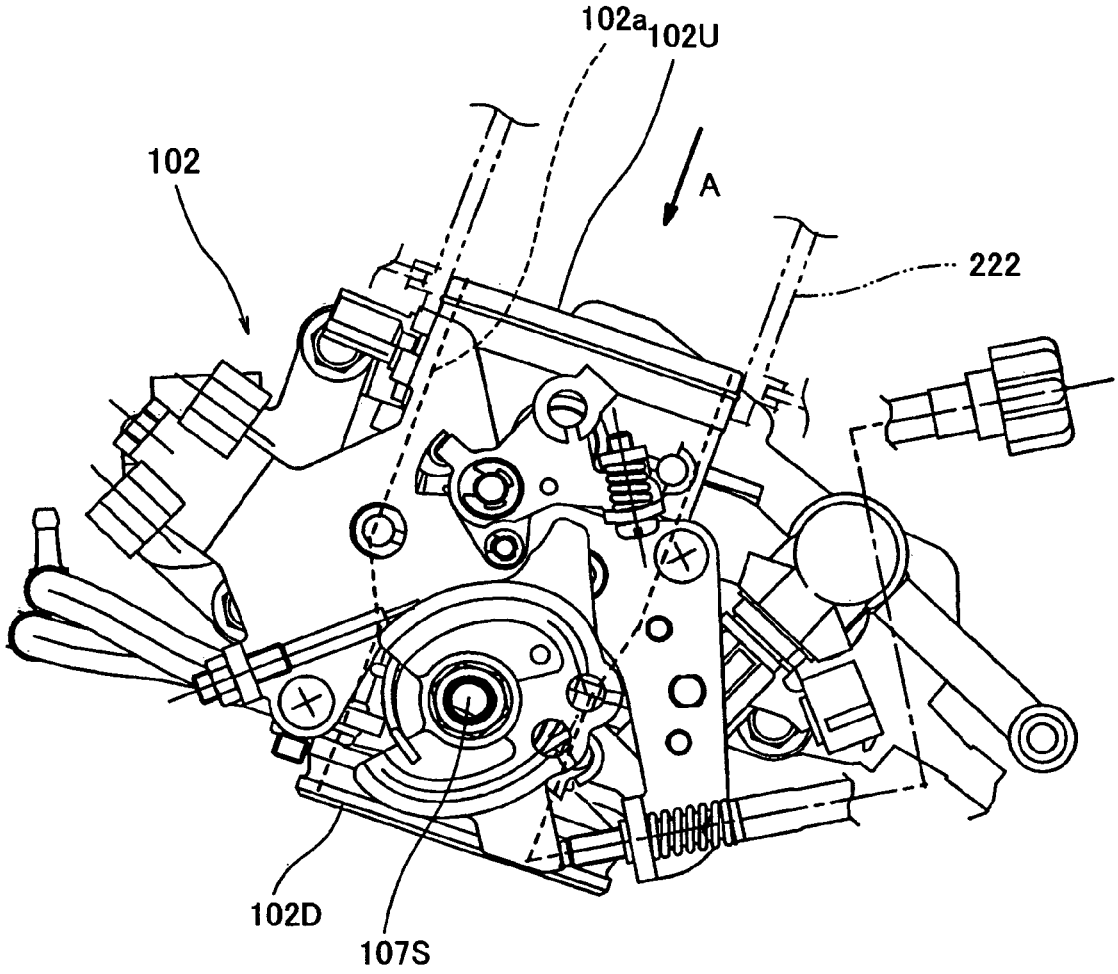
FIG. 6 is an enlarged side view of the throttle body of FIG. 5.
Figure 8:
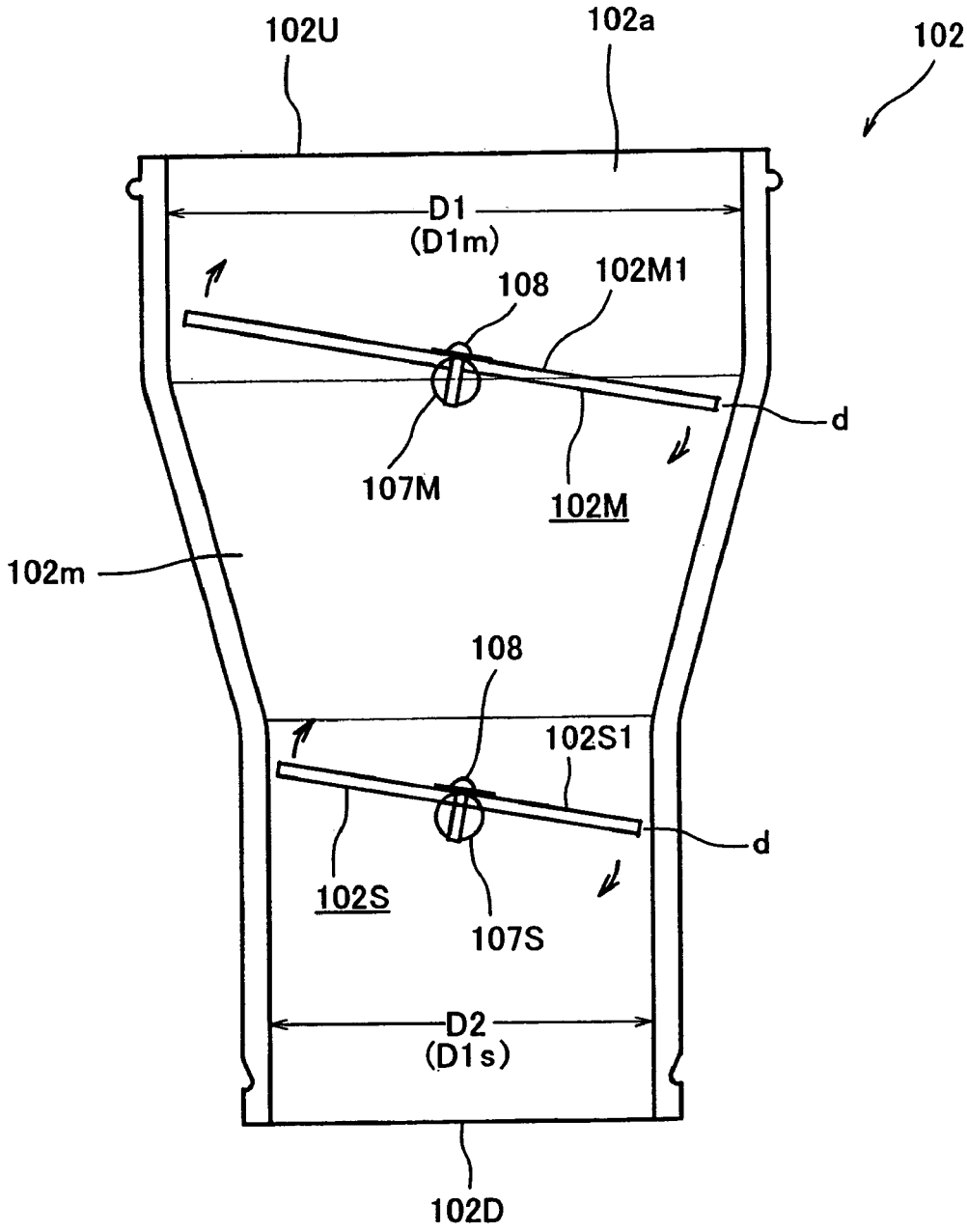
FIG. 8 is a cross-sectional view taken along a longitudinal direction of the air-intake passage of the throttle body.

As indicated by a broken line of FIG. 6 and as illustrated in an enlarged cross-section of the air-intake passage 102*a* of FIG. 8, the air-intake passage 102*a* of the throttle body 102 has an intermediate portion 102*m* which is partially tapered such that a cross-sectional area decreases from the upstream end 102U side to the downstream end 102D side. The upstream end 102U portion and the downstream end 102D portion are straight-pipe shaped.

As shown in FIG. 8, a main throttle valve 102M is mounted in a passage 102*a* of a region of the throttle body 102 which is closer to the upstream end 102U and is straight-pipe shaped and is configured to be pivotable by a predetermined angle (for example, approximately 10 to 85 degrees) around a main throttle valve shaft (pivot) 107M which is rotatably operated by a mechanical or electric system by the operator. In addition, a sub (auxiliary) throttle valve 102S is mounted in a region of the passage 102*a* of the throttle body 102 which is closer to the downstream end 102D and is straight-pipe shaped and is configured to be pivotable by a predetermined angle (for example, approximately 10 to 85 degrees) around a sub-throttle valve shaft (pivot) 107S which is rotatably operated by an actuator such as a motor. In the throttle body 102 of this embodiment, in order to achieve a quick response to the engine E, the throttle valves 102M and 102S are mounted within the air-intake passage 102*a*.

Figure 7:
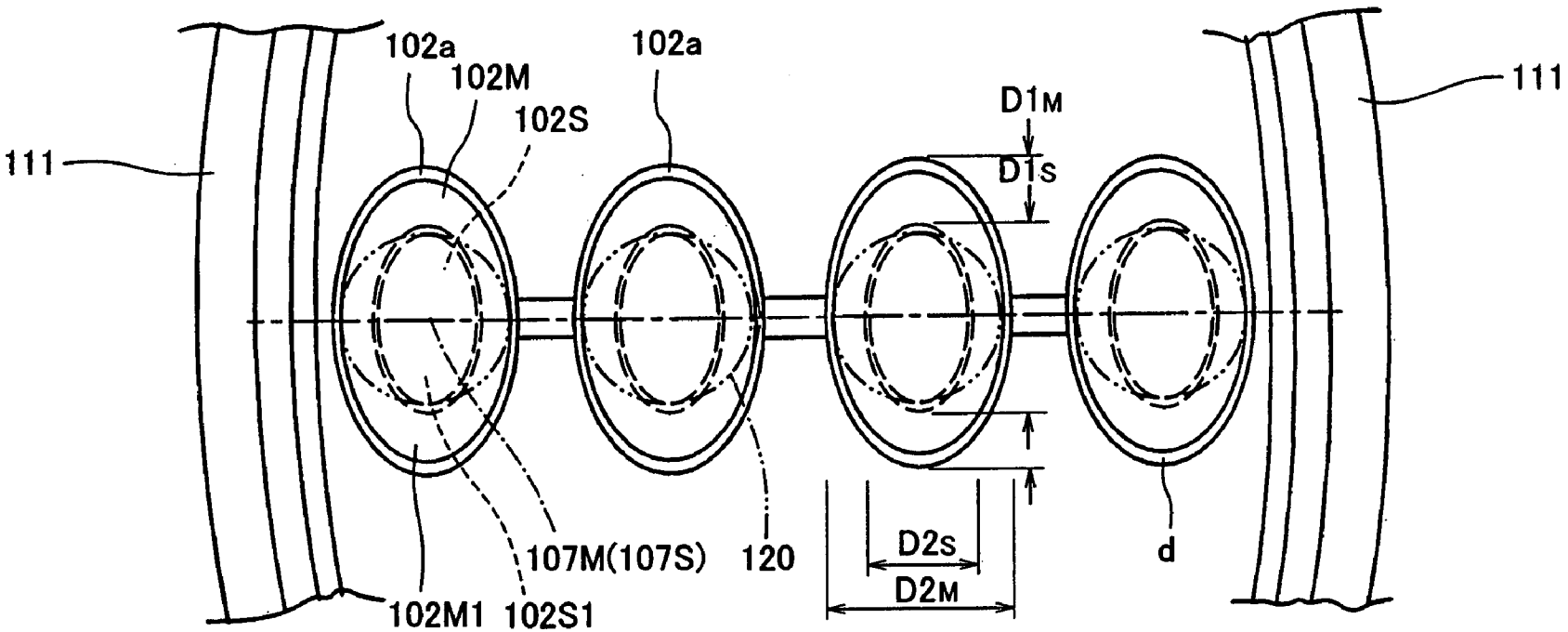
FIG. 7 is a view taken in the direction of arrows VII—VII of FIG. 5, schematically showing a cross-sectional shape of air-intake passages of the throttle bodies of FIG. 6.

As shown in FIG. 7, the air-intake passage (non-perfect circle portion) 102*a* of the throttle body 102 of this embodiment has a cross-section having a long axis (major-axis portion) D1M and a short axis (minor-axis portion) D2M and a cross-section having a long axis (major-axis portion) D1S and a short axis (minor-axis portion) D2S. In other words, the cross-section of over the length of the passage of the non-perfect circle portion is of an oval shape. Specifically, the short axes D2M and D2S extend in the lateral direction (width direction of the motorcycle and the long axes D1M and D1S extend in the direction substantially perpendicular to the lateral direction. In FIG. 7, for the sake of comparison, two-dotted line 120 indicates a virtual perfect circle shape of the conventional air-intake passage 10*a* having the diameter "D" equal to the short axis D2M. As shown in FIG. 7, each of a main throttle valve member 102M1 of the main throttle valve (first throttle valve) 102M and a sub-throttle valve member 102S1 of the sub-throttle valve (auxiliary throttle valve) 102S has a cross-section of a substantially oval shape having long and short axes so as to correspond to the corresponding cross-sectional area of the air-intake passage 102*a*, as viewed from the front (from a direction substantially perpendicular to the direction of the air flow within the air-intake passage 102*a*). To be precise, to enable the main throttle valve member 102M1 and the sub-throttle valve member 102S1 to be smoothly pivotable to open and close, they are formed in a substantially oval shape which is similar to and slightly smaller than the oval shape of the air-intake passage 102*a*. In FIG. 7, for easier understanding, "clearance d" between the throttle valve members 102M1 and 102S1 and a peripheral wall of the air-intake passage 102*a* is illustrated as being enlarged. As shown in FIG. 8, the main throttle valve member 102M1 is pivotable around the main throttle valve shaft (pivot) 107M located at the center and the sub-throttle valve member 102S1 is pivotable around the sub-throttle valve shaft (pivot) 107S located at the center. The main throttle valve member 102M1 is pivotally fastened to the main throttle valve shaft (pivot) 107M by a bolt 108. The sub-throttle valve member 102S1 is pivotally fastened to the sub-throttle valve shaft (pivot) 107S by a bolt 108. In the second embodiment, the main throttle valve 102M is formed by fastening the throttle valve member 102M1 to the main throttle valve shaft (pivot) 107M by the bolt 108 and the sub-throttle valve 102S is formed by fastening the sub-throttle valve member 102S1 to the sub-throttle valve shaft 107S by the bolt 108.

Figure 9:
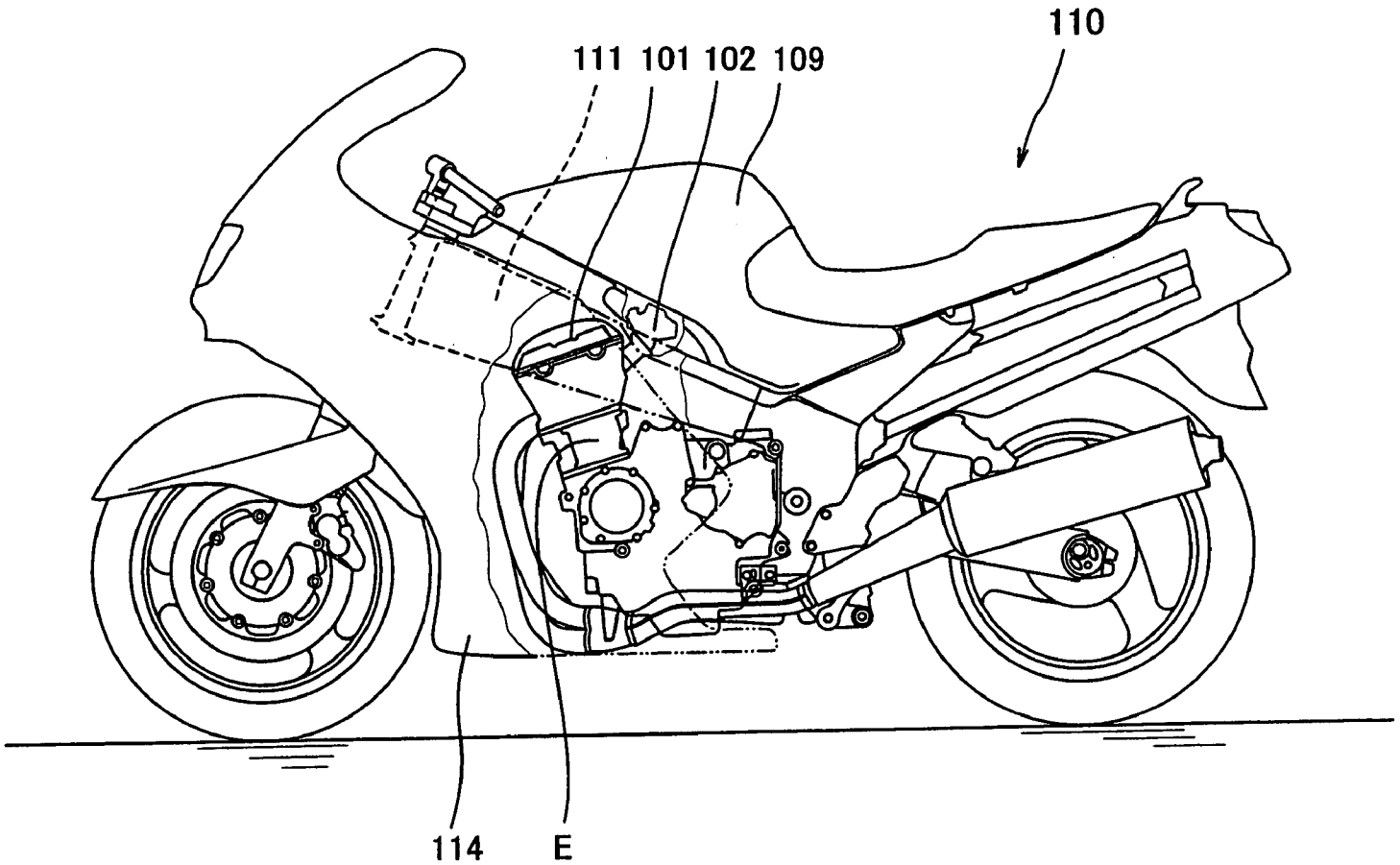
FIG. 9 is a side view of a motorcycle in which an engine of FIG. 5 is mounted, with a cowling and a frame being partly cut away.
Figure 10:
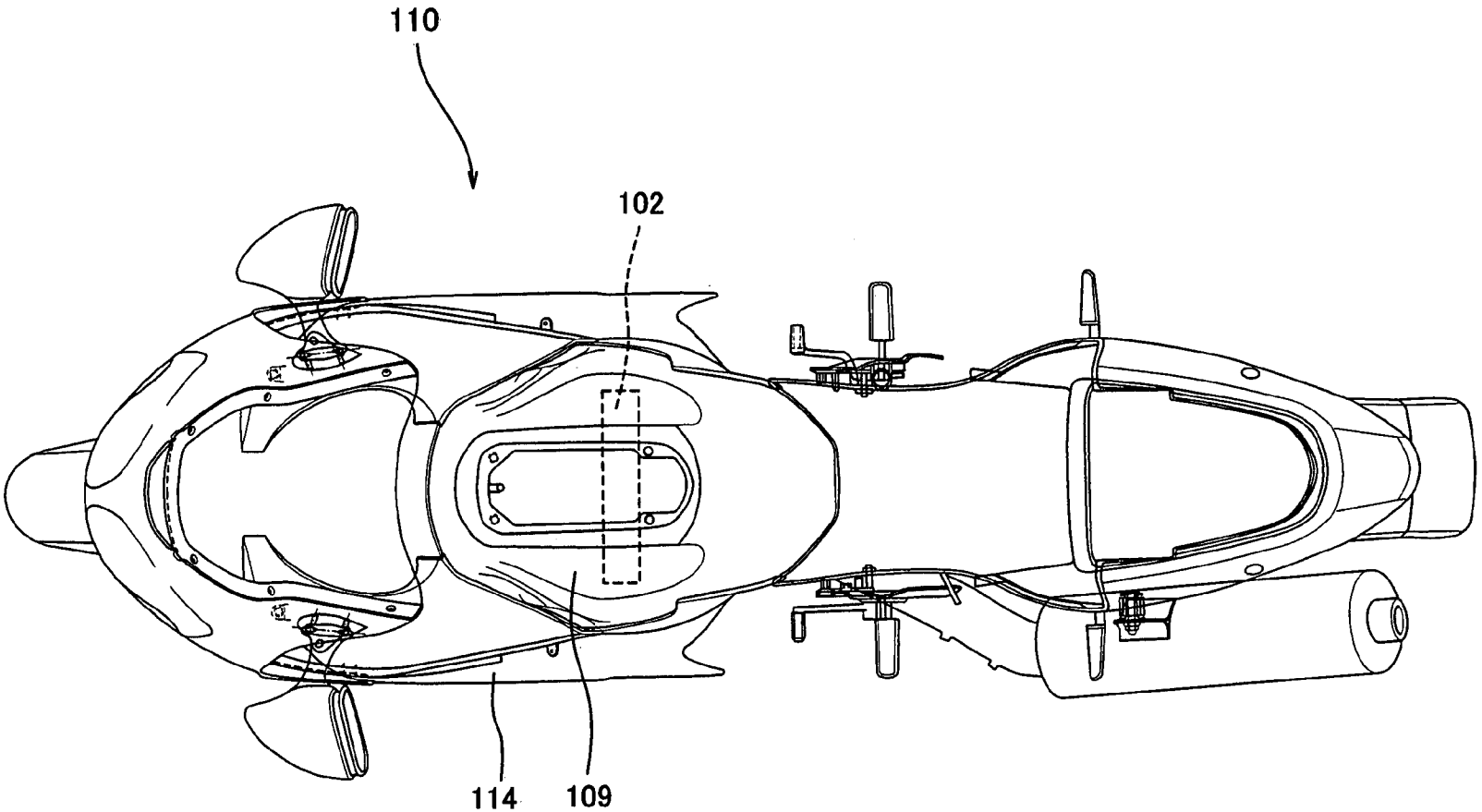
FIG. 10 is a plan view of the motorcycle of FIG. 9.

As shown in FIG. 9, the engine E provided with the throttle body 102 above the cylinder head 101 is mounted in the vehicle body of the motorcycle 110 in such a manner that the throttle body 102 is positioned between right and left parts of the main frame 111 of the motorcycle 110 which are spaced apart from each other in the lateral direction. In FIG. 9, a cowling 114 and the main frame 111 are partially cut away to make the throttle body 102 visible. The throttle body 102 is positioned on inner side of the knees of the rider straddling the motorcycle 110. As viewed from another perspective, the throttle body 102 is mounted between the cylinder head 101 of the engine E and a fuel tank 109. As viewed from above the motorcycle 110, the throttle body 102 is disposed as indicated by a broken line of FIG. 10.

In the engine E of the motorcycle 110 constructed above, since the air-intake passage 102*a* of the throttle body 102 has the cross-section having the short axis in the width direction which is equal to that of the diameter "D" of the perfect circle shape of the conventional air-intake passage 10*a* of FIG. 4 and the long axis in the direction substantially perpendicular to the width direction which is larger than the diameter "D", the cross-sectional area of the air-intake passage 102*a* can be increased without increasing the entire width of the throttle bodies 102. Since the dimension of the main frame 111 in the width direction of the motorcycle 110 does not substantially increase irrespective of an increase in the cross-sectional area of the air-intake passages 102*a*, the rider is not forced to open the knees to an undesirable extent while the rider is straddling the seat.

In accordance with the engine E of the motorcycle constructed above, an output power of the engine E increases because of the increase in the cross-sectional area of the air-intake passages 102*a* of the throttle bodies 102. In addition, an exhaust gas can be cleaned by supplying fresh air in larger amount.

(Embodiment 3)

Figure 11:
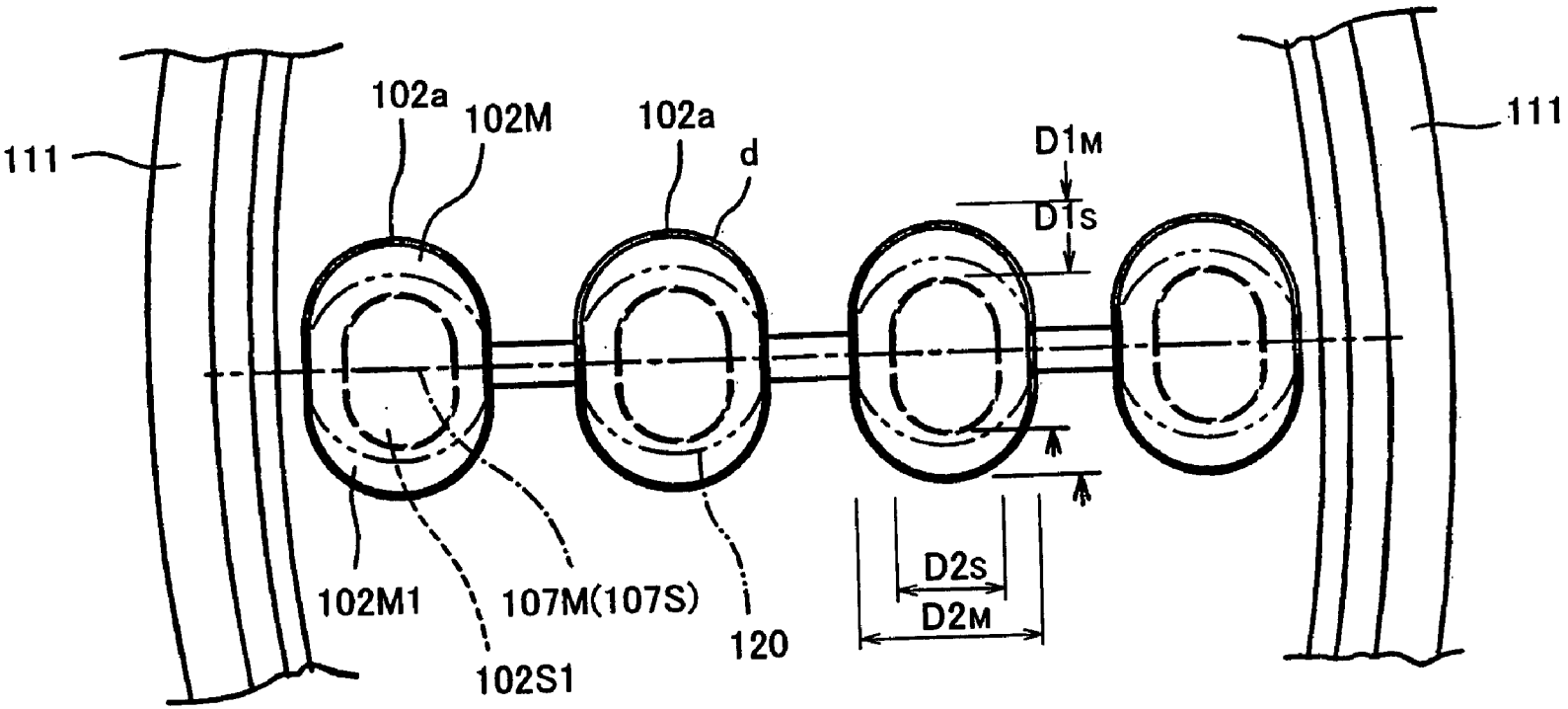
FIG. 11 is a cross-sectional view schematically showing another cross-sectional shape of the air-intake passage of FIG. 8.

Turning to FIG. 11, the air-intake passage 102*a* of the throttle body 102 according to a third embodiment of the present invention has a cross-section of an elongated circle shape having a long axis D1M and a short axis D2M and a cross-section of an elongated circle shape having a long axis D1S and a short axis D2S. Each elongated circle shape is formed by semicircles with the same diameter and straight lines connecting the semicircles.

The main throttle valve member 102M1 of the main throttle valve 102M and the sub-throttle valve member 102S1 of the sub-throttle valve 102S are formed to have elongated circle shapes which are similar to and are slightly smaller in size than the elongated circle shapes of the corresponding regions of the air-intake passage 102*a*.

In this embodiment, since the air-intake passage 102*a* and the throttle valve members 102M1 and 102S1 are formed by semicircular portions and straight-line portions, they are easier to manufacture than those of the oval shape of the second embodiment. In addition, the clearance "d" between the air-intake passage 102*a* and the main throttle valve member 102M1 or the sub-throttle valve member 102S1 can be manufactured with higher precision. In FIG. 11, reference designator 107M is a main throttle valve shaft (pivot) to which the main throttle valve member 102M1 is pivotally attached, reference designator 107S denotes a sub-throttle valve shaft (pivot) to which the sub-throttle valve member 102S1 is pivotally attached, and two-dotted line 120 indicates a virtual perfect circle of conventional air-intake passage 10*a*.

While the air-intake passage 102*a* of the throttle body 102 is formed to have the cross-section of the oval shape or the elongated circle shape having long and short axes (major-axis and minor-axis portions) over the entire length in the second and third embodiments, a cross-section of only a part of the air-intake passage 102*a* in the longitudinal direction, for example, a minimum cross-section of the air-intake passage 102*a* may alternatively be formed in the oval shape or the elongated circle shape.

(Embodiment 4)

Desirably, an upstream end portion of the air-intake passage 102*a* formed in the throttle body 102 in the first to third embodiments is structured as described below. Hereinbelow, a structure surrounding the air-intake passage 102*a* will be described with reference to FIG. 12.

Figure 12:
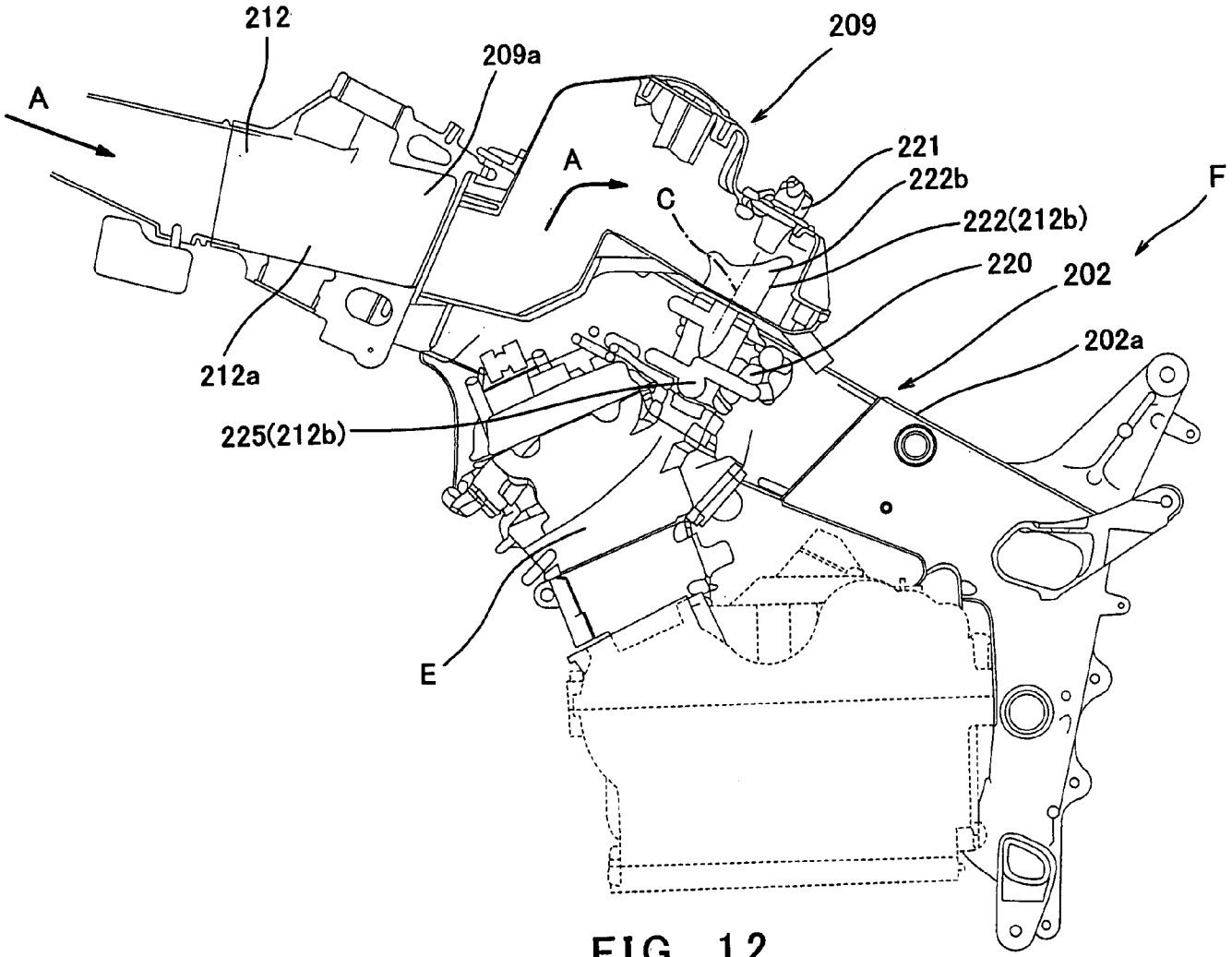
FIG. 12 is a partial side view of a motorcycle in which an engine provided with a throttle body is mounted, according to an embodiment of the present invention.

Turning now to FIG. 12, the air cleaner box 209 is disposed between a pair of right and left main frame members 202*a* forming a main frame 202 of a vehicle body F. In order to allow air to be taken in from outside the motorcycle 110 to be guided to the air cleaner box 209 through an air-conduction passage 212, an upstream portion 212*a* of the air-conduction passage 212 extends from an air inlet formed on a front face of a front cowling (not shown), through a front end portion of the main frame 202, and to an opening 209*a* formed on a front face of the air cleaner box 209.

The engine E is mounted in a lower portion of a center section of the vehicle body F and is positioned below the air cleaner box 209. An upstream end portion of the introducing duct 222 that forms a part of a downstream portion 212*b* of the air-conduction passage 212 which is located downstream of the air cleaner box 209 and has a cross-section of a substantially oval shape in a direction substantially perpendicular to a center axis C of the air-intake passage 102*a* protrudes into the air cleaner box 209. A downstream end of the introducing duct 222 is connected to the air-intake passage (intake port) of the engine E through the air-intake passages 2 or 102 (see FIGS. 1, 2, 5, and 6) formed in a throttle body 225.

Figure 13:
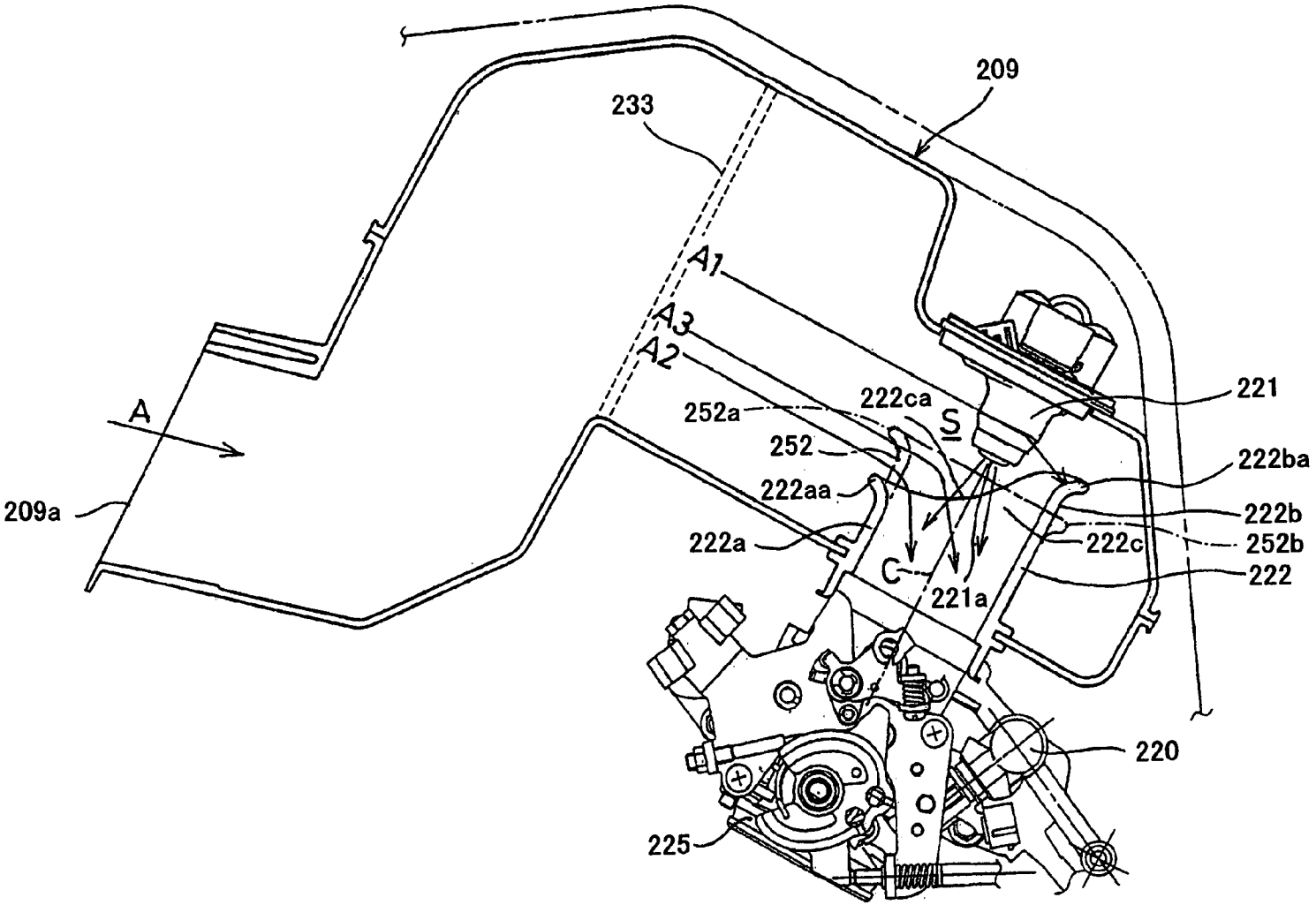
FIG. 13 is a partial longitudinal sectional view showing main components of an air-intake device of the engine of FIG. 12.

When the engine E of the motorcycle 110 is an engine having a double injector configuration, as shown in FIG. 13, it has a fuel injector 220 provided with a fuel injection port located downstream of a throttle valve (e.g., main throttle valve of the first to third embodiments) and a second fuel injector 221 provided with a fuel injection port at a location within the air cleaner box 209 which is opposite to an inlet of the introducing duct 222.

The first and second fuel injectors 220 and 221 are controlled to inject a fuel in response to a load of the engine E. That is, a fuel injection amount of the first and second fuel injectors 220 and 221 is adjusted according to the load of the engine E. For example, during a low load condition of the engine E, the fuel is injected only from the first fuel injector 220, while during a high load condition of the engine E, the fuel is injected from both the first and second fuel injectors 220 and 221.

An upper end 222*ba* of a rear wall 222*b* of the introducing duct 222 is positioned higher than the fuel injection port 221*a* of the second fuel injector 221. Such a structure makes it possible to inhibit air "A" from flowing above the introducing duct 222, and hence to inhibit the fuel injected from the fuel injection port 221*a* from leaking outside the introducing duct 222.

As shown in FIGS. 12 and 13, the fuel injection port 221*a* of the second fuel injector 221 is provided at the location opposite to the inlet of the introducing duct 222. Because the fuel injection port 221*a* is thus positioned, an air-intake space S above the introducing duct 222 decreases. To fully address this, the rear wall 222*b* of the introducing duct 222 is set higher than the front wall 222*a* to substantially make an opening area (air-intake area) of the introducing duct 252 larger than that of a structure with the rear wall 222*b* being as high as the front wall 222*a*. By setting the rear wall 222*b* higher and the front wall 222*a* lower, the air "A1" flowing above an introducing duct 252 (indicated by two-dotted line) with a front wall 252*a* being as high as a rear wall 252*b* can be guided into the introducing duct 222, and air "A2" flowing under an opening of the introducing duct 252 with the front wall 252*a* being as high as the rear wall 252*b* can be guided into the introducing duct 222. As a result, air-intake efficiency increases.

An upper end 222*ca* of a side wall 222*c* connecting the front wall 222*a* to the rear wall 222*b* of the introducing duct 222 is smoothly curved and is concave-shaped as viewed from the side. The concave-shaped upper end 222*ca* of the side wall 222*c* enables air A3 flowing from lateral side within the air-cleaner box 209 to be drawn into the introducing duct 222. Since a larger amount of air can be drawn into the introducing duct 222, air-intake efficiency further increases.

Figure 14:
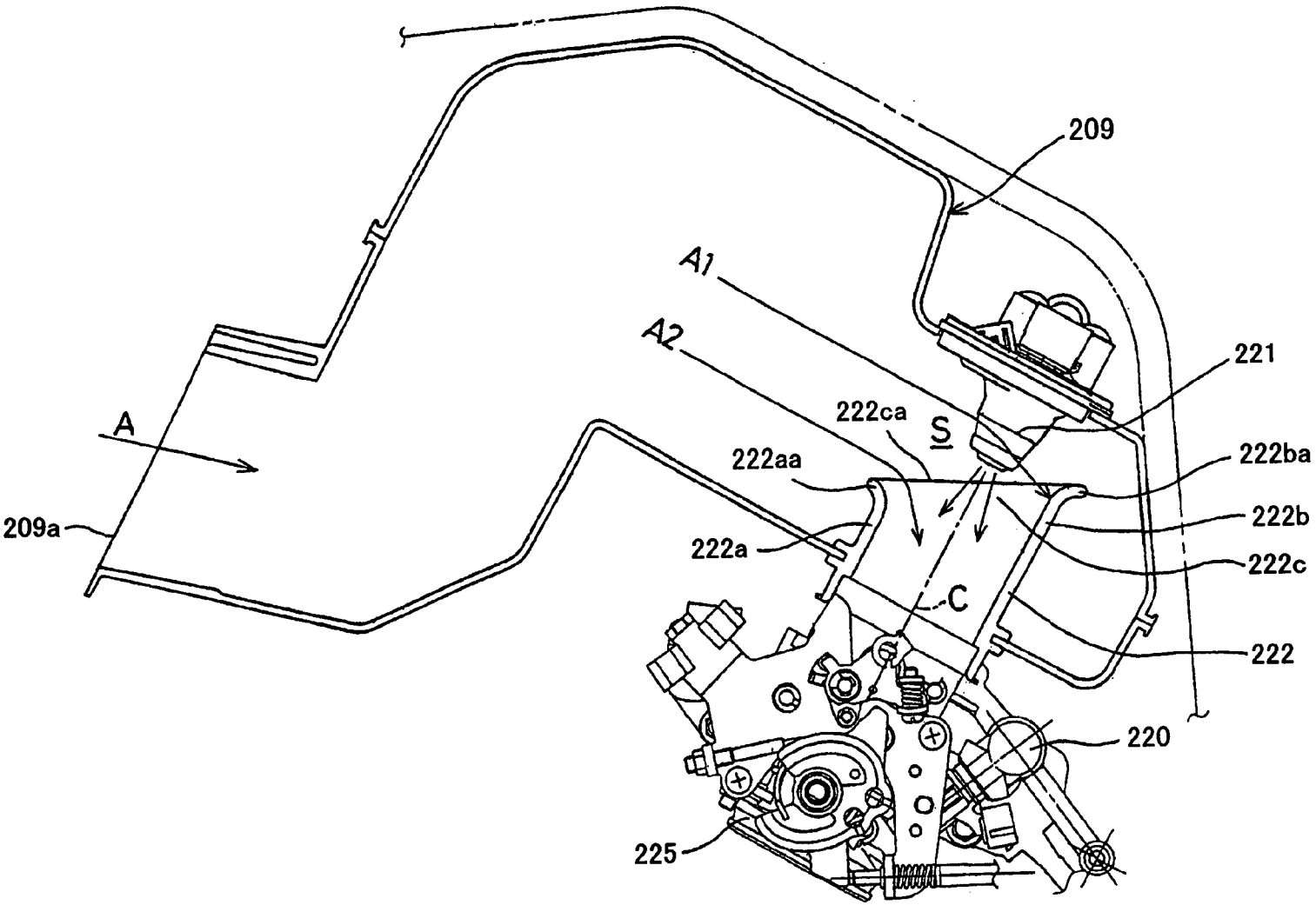
FIG. 14 is a partial longitudinal sectional view showing another construction of the main components of the air-intake device of the engine.

The introducing duct 222 may alternatively be structured as shown in FIG. 14. As shown in FIG. 14, the upper end 222*ca* of the side wall 222*c* of the introducing duct 222 is not concave-shaped, unlike in the introducing duct 222 of FIGS. 12 and 13. In the embodiment of FIG. 14, the upper end 222*ca* of the side wall 222*c* of the introducing duct 222 connects the upper end 222*aa* of the front wall 222*a* to the upper end 222*ba* of the rear wall 222*b* in a straight line shape as viewed from the side. Since the introducing duct 222 is structured such that the rear wall 222*b* is located higher than the front wall 222*a*, the opening area (air-intake area) of the introducing duct 222 increases to enable a larger amount of air to be drawn into the introducing duct 222, thereby increasing air-intake efficiency, as compared to the introducing duct 222 with the rear wall 222*b* being as high as the front wall 222*a*.

Figure 15:
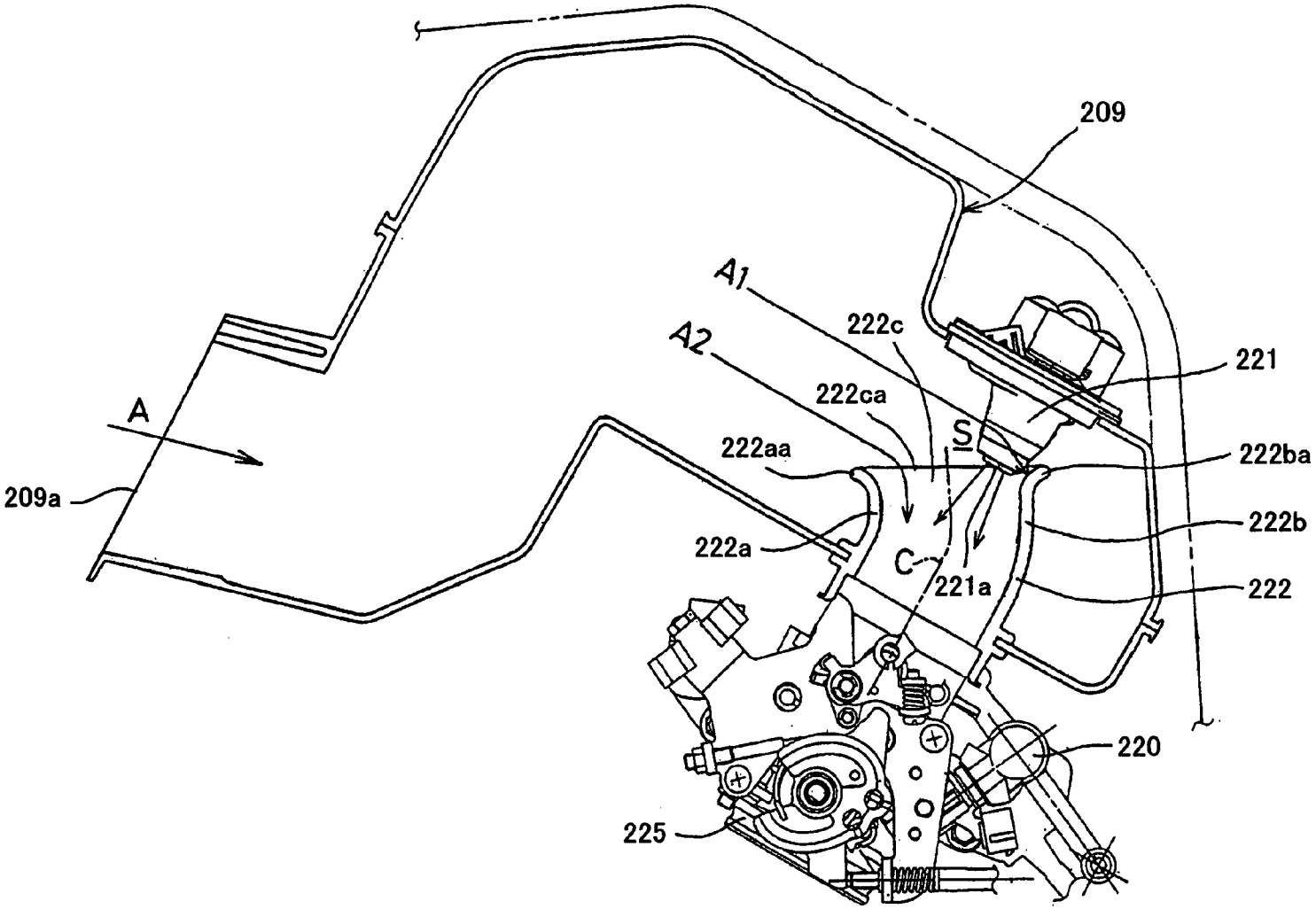
FIG. 15 is a partial longitudinal sectional view showing another construction of the main components of the air-intake device of the engine.

Alternatively, the introducing duct 222 may be structured as shown in FIG. 15. In this embodiment, as in the embodiment shown in FIG. 14, the upper end 222*aa* of the front wall 222*a* is connected to the upper end 222*ba* of the rear wall 222*b* in a straight-line shape. In the structure of FIG. 15, a center axis C of the air-intake passage of the introducing duct 222 is slightly inclined forward and curved. In this embodiment, also, the introducing duct 222 is structured such that the rear wall 222*b* is located higher than the front wall 222*a*. This increases the amount of air-intake and hence air-intake efficiency as in the embodiments shown in FIGS. 12 to 14.

When the embodiments shown in FIGS. 12 to 14 are applied to an engine having a plurality of cylinders, the introducing ducts 222 corresponding to respective cylinders may be formed to have passages, the lengths of which differ from one another. As a result, air-intake efficiency further increases.

While the cross-section of the introducing duct 222 in the direction substantially perpendicular to the center axis C has an oval shape in the embodiments of FIGS. 12 to 14, it alternatively may have other shapes, including a circle, an elongated-circle, a rectangle, a parallelogram, etc.

While the upper end 222*ba* of the rear wall 222*b* of the introducing duct 222 is positioned higher than the fuel injection port 221*a* of the second fuel injector 221 in the embodiments shown in FIGS. 12 to 14, it alternatively may be positioned lower than or substantially as high as the fuel injection port 221*a* so long as the fuel injected from the fuel injection port 221*a* does not leak outside the introducing duct 222.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A throttle body configured to supply air to an air-intake port of an engine, comprising:

an air-intake passage through which air flows, the air-intake passage at least partially having a non-perfect circle portion with a cross-section of a non-perfect circle shape in a direction substantially perpendicular to a direction of an air flow of air taken in from outside, the non-perfect circle shape having long and short axes, the short axis extending in a width direction of the throttle body; and at least one of a first throttle valve and a second throttle valve which are mounted within the non-perfect circle portion of the air-intake passage and include throttle valve members each having a shape conforming to the non-perfect circle shape of the cross-section of the non-perfect circle portion of the air-intake passage, the first throttle valve and the second throttle valve being each configured to control an amount of the air flow;

wherein the at least one of the first throttle valve and the second throttle valve is configured to be opened and closed to substantially open and close the air-intake passage.

2. The throttle body according to claim 1, wherein the cross-section of the non-perfect circle portion has a substantially oval shape or a substantially elongated circle shape.

3. A throttle body configured to supply air to an air-intake port of an engine, comprising:

an air-intake passage through which the air flows, the air-intake passage being configured to extend within the throttle body;

a main throttle valve member pivotally mounted within the air-intake passage and attached to a main throttle valve shaft;

a sub-throttle valve member that is pivotally mounted within a region of the air-intake passage which is located upstream of the main throttle valve member and that is attached to a sub-throttle valve shaft, the sub-throttle valve member being configured to be driven by a motor;

wherein the region of the air-intake passage which is located upstream of the main throttle valve member has a substantially oval shape having long and short axes or a substantially elongated circle shape having long and short axes, the short axis extending to conform to an axis of the sub-throttle valve shaft and the long axis extending in a direction substantially perpendicular to the axis of the sub-throttle valve shaft.

4. An engine of a motorcycle comprising:

a cylinder having a cylinder head;

an intake passage formed within the cylinder head;

a throttle body disposed upstream of the intake passage in an air flow of air taken in from outside, the throttle body including:

an air-intake passage through which air flows, the air-intake passage at least partially having a non-perfect circle portion with a cross-section of a non-perfect circle shape in a direction substantially perpendicular to a direction of the air flow, the non-perfect circle shape having long and short axes, the short axis extending in a width direction of the throttle body; and a first throttle valve or a second throttle valve, or the first and the second throttle valves which are mounted within the non-perfect circle portion of the air-intake passage and include throttle valve members each having a shape conforming to the non-perfect circle shape of the cross-section of the non-perfect circle portion of the air-intake passage, the first throttle valve and the second throttle valve being each configured to control an amount of the air flow;

wherein the at least one of the first throttle valve and the second throttle valve is configured to be opened and closed to substantially open and close the air-intake passage.

5. The engine according to claim 4, wherein the cross-section of the non-perfect circle portion has a substantially oval shape or a substantially elongated circle shape.

6. The engine according to claim 4, further comprising:

an introducing duct connected to an upstream end of the air-intake passage of the throttle body and configured to extend to cross the air flow such that a downstream portion of a wall of the introducing duct in an air flow of the air before being introduced into the duct is longer than an upstream portion of the wall of the introducing duct.

7. The engine according to claim 6, further comprising:

a fuel injector having a fuel injection port configured to open toward an opening of the introducing duct, wherein the downstream portion of the wall of the introducing duct is configured to extend so as to be slightly shorter or longer than a length from a base end of the downstream portion to a location in a longitudinal direction of the introducing duct at which the fuel injection port and a tip end of the downstream portion conform to each other.

8. The engine according to claim 6, wherein the introducing duct is configured to open such that a line connecting a tip end of the upstream portion of the wall of the duct to a tip end of the downstream portion of the wall of the duct is concave-shaped as seen from a side.

9. The engine according to claim 4, wherein the cross-section of the non-perfect circle portion has a substantially oval shape or a substantially elongated circle shape, the engine further comprising:

an introducing duct connected to an upstream end of the air-intake passage of the throttle body, wherein the introducing duct has a cross-section of a substantially oval shape or a substantially elongated circle shape to conform to the non-perfect circle shape of the cross-section of the air-intake passage of the throttle body when sectioned in a direction which is perpendicular to the air flow of the taken-in air.

10. The engine according to claim 4, wherein the cylinder is one of a plurality of cylinders of the engine, and the throttle body includes a plurality of throttle bodies respectively attached to the cylinders and having air-intake passages, the engine further comprising:

a plurality of introducing ducts connected to upstream ends of the air-intake passages of the throttle bodies, at least one of the introducing ducts being configured not to have a length equal to lengths of remaining introducing ducts.

11. The engine according to claim 4, wherein one of the first and second throttle valves which is located on an upstream side in the air flow is configured to be opened and closed by an actuator.

* * * * *